United States Patent [19]

Campbell

[11] 3,995,677

[45] Dec. 7, 1976

[54] METHOD AND APPARATUS FOR CASTING HOLLOW INGOT MOLDS

[75] Inventor: T. Bruce Campbell, W. Middlesex, Pa.

[73] Assignees: Thomas S. Campbell; Robert E. Campbell, both of W. Middlesex, Pa.

[22] Filed: Nov. 26, 1975

[21] Appl. No.: 635,608

[52] U.S. Cl. ..... 164/15; 164/137; 164/365; 249/204

[51] Int. Cl.[2] ..... B22C 9/02

[58] Field of Search ..... 164/349–356, 164/361, 364–370, 15, 137

[56] References Cited

UNITED STATES PATENTS 2,025,336 12/1935 Brearley ..... 164/369 X

FOREIGN PATENTS OR APPLICATIONS 1,583,532 6/1970 Germany ..... 164/369

*Primary Examiner*—Robert D. Baldwin

*Attorney, Agent, or Firm*—Parmelee, Miller, Welsh & Kratz

[57] ABSTRACT

An ingot mold has been devised which instead of utilizing a full protective thickness or section of sand within the spacing between a metal core bar and a metal flask, employs a refractory lining for the flask and a refractory coat for the bar that respectively have a cross extent or thickness that occupies a greater portion of the spacing than the casting sand. The casting sand is utilized as a minimum inner thickness to define the casting mold and as imposed between the refractory lining and coat.

12 Claims, 3 Drawing Figures

METHOD AND APPARATUS FOR CASTING HOLLOW INGOT MOLDS

BACKGROUND OF THE INVENTION

1. Field of the Invention

This invention relates to an improved approach to the casting of metal ingot molds and particularly, to an improved method and assembly which minimize the quantity requirements for casting sand. A phase of the invention deals with an approach to casting ingot molds which will provide an effectively combined usage of an inwardly positioned refractory lining and refractory coat with quick-set cheek casting sand.

2. Description of the Prior Art

It has heretofore been customary in the forming of cast hollow ingot molds to make use of ordinary silica casting sand for both protecting the metal parts and providing a mold cavity and which after the shaping of the mold cavity, requires a fuel-applied baking period of about 24 hours. Although Quaker Oats Company, as well as Ashland Oil have made available a so-called quick or air set synthetic sand for casting which saves energy from the standpoint of drying fuel and may be set within a short drying period of about 30 minutes, its usage has not been entirely satisfactory employing the type of mold assemblies that have heretofore been available. The expense has been somewhat prohibitive in view of the conventional, one-use, quantity required for the casting of ingot molds due to their relative large sizes.

In today's environment there is a definite need to not only conserve fuel and other forms of energy, but to avoid pollution and, in this connection, to minimize the quantity of core sand that must be discarded. Using present practice, the flask is faced with a heavy thickness of cheek sand and the of core bar with a heavy thickness core sand, with the molten iron being poured within the mold cavity between them to form the casting. A relatively large volume of sand is required for the operation. Even when ordinary sand is used, a large percentage of the sand must be discarded and replaced. In most cases the complete volume must be discarded.

Although this sand problem has heretofore been minor, it is now an important factor from the standpoint of finding a suitable dumping spot and also from the standpoint of the higher present day cost of even ordinary sand. Thus, there is a need for decreasing the quantity of sand required in the casting operation. As will be appreciated, the quantity may be very large using the conventional approach, since ingot mold castings usually run in the size range of 500 to 50,000 lbs.

There is a need for protecting as well as for minimizing wear and tear on the metal casting flask and core bar, in addition to minimizing the amount of sand that has to be discarded, and in making practical the full employment of so-called quick-set, air drying resin-containing casting sand.

SUMMARY OF THE INVENTION

It has thus been an object of the invention to find a practical solution to the problem presented under present day conditions from the standpoint of improving the technology employed in casting metal ingot molds.

Another object has been to discover factors entering into member assembling and casting procedure that may be changed and improved to meet the problem presented.

Another object of the invention has been to utilize refractory wall thickness portions in the spacing between metal casting members employed for making ingot molds and, in such a manner, as to minimize sand requirements and the time involved.

A further object of the invention has been to utilize opposed, inner refractory walls between metal casting members to fill a maximum portion of the spacing and as a practical and economical substitute for a major portion of the casting sand usually required.

A further object of the invention has been to provide casting members that will have an improved operating life and that in usage will enable an effective utilization of quick set casting sand and in a minimized quantity.

These and other objects of the invention will appear to those skilled in the art in view of the illustrated embodiment and the claims.

Figure 1:
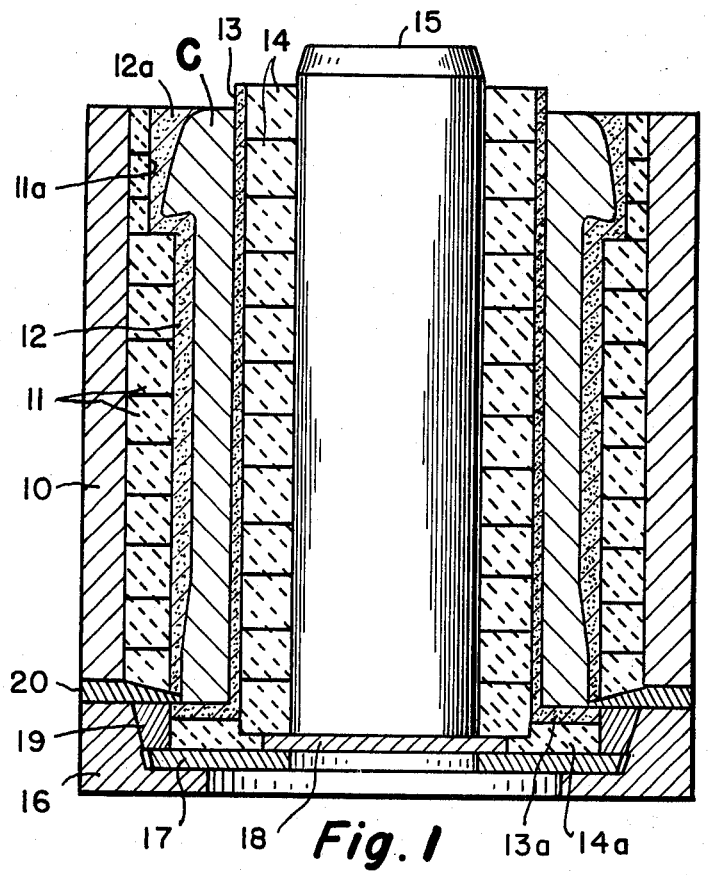
FIG. 1 is a side section in elevation through an ingot mold casting assembly constructed and employed in accordance with the invention; this view shows a mold casting in a formed position within the assembly.
Figure 2:
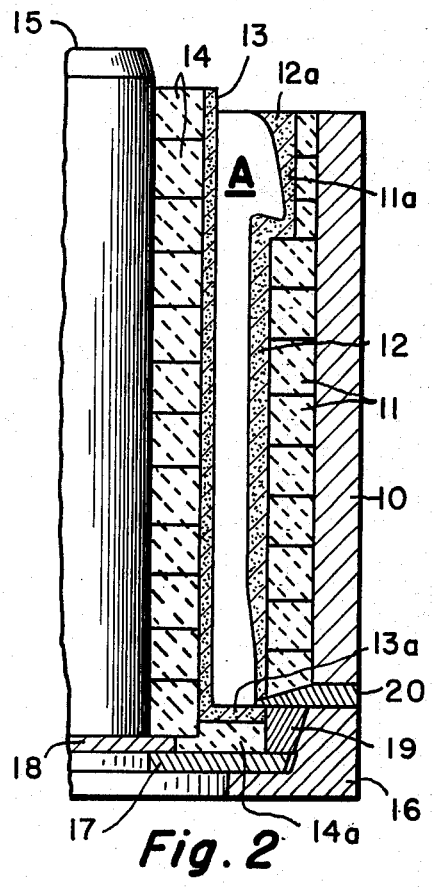
FIG. 2 is a fragmental sectional elevation on the same scale as FIG. 1, but showing the assembly before casting metal has been poured into its casting cavity.
Figure 3:
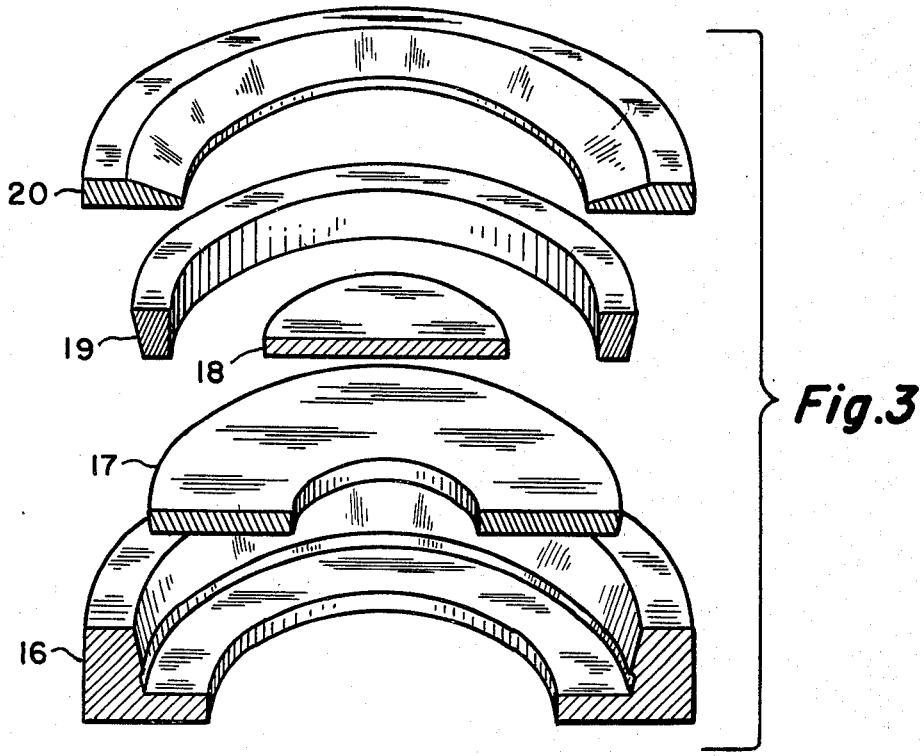

And, FIG. 3 is an exploded persepctive view particularly illustrating parts utilized in closing-off a lower or bottom end of the assembly of FIGS. 1 and 2.

DESCRIPTION OF THE PREFERRED EMBODIMENT

Referring particularly to FIGS. 1 and 2, I have shown a mold assembly for casting ingot molds which includes an outer metal flask 10 of hollow cylindrical shape and as provided with an adherent inner refractory lining 11 which may be of cemented-in furnace tile or brick member construction. An upper mouth portion of the refractory lining 11 has an outwardly offset, thinner wall ledge portion 11a to provide for the shaping of mold cavity A to a desired shape for the mouth of a metal ingot mold C that is to be cast. A relatively thin thickness or outer layer of cheek sand 12 cooperates with a second, innermost, relatively thin thickness or layer of cheek sand 13, primarily in a sufficient amount to define the mold cavity A of FIG. 2. It is this cavity in which the metal is poured and cooled into a casting C to provide a suitable ingot mold. It will be noted that a lower flange end or foot portion 13a of the sand layer 13 extends along the base of the mold cavity A, and terminates at its outer end in alignment with a bottom edge of the outer sand layer 12.

A core bar member 15 of solid metal construction is positioned centrally within the assembly and carries a refractory coat 14 fully along and thereabout which is cemented in place thereon, and which serves to protect and insulate the core bar 15 from the heat of the metal being cast and to support the innermost sand thickness portion 13. The coat 14 may be of the same cemented-together and in-place refractory tile or fire brick construction as the lining 11. Of importance, as illustrated in FIGS. 1 and 2, is the fact that the refractory lining 11, as well as the refractory coat 14, are of greater cross sectional thicknesses than either of the thicknesses 12 and 13 of the sand. The lining 11 and the coat 14 essentially and more effectively protect the flask 10 and the core 15, and constitute a major portion of width of the casting space. The sand occupies a minor portion of the casting space and is now primarily used to provide or define the substantially enclosed mold cavity A. It has been found important to provide a maximum thickness of the refractory material and a minimal thickness of the sand, with an optimum, thickness of each of the refractory portions 11 and 12 of at least about twice the thickness of each of the respective sand portions 12 and 13.

Contrary to the heretofore held belief of the need from a thermal standpoint for the full provision of a discardable sand material between the flask and core bar and in providing the mold cavity, refractory linings 11 and 14 give even better thermal protection to the metal parts and, in combination with relatively thin, innermost layers of cavity molding sand, provide cast molds having improved physicals. The lining 11 and coat 14 are highly durable and are securely mounted in position to stand-up under a large number of casting operations.

Attention is called to the fact that the coat refractory 14 has an outwardly extending bottom foot portion 14a that protects a removable assembly of metal bottom members, including a direct core supporting, disc-like closure plate member 18, an outer or lower, inset plate member 17 having an open center and whose upper face the plate 18 rests, and a lowermost, angle-shaped bottom supporting, ring-like rim member 16. An upper closure ring of somewhat wedge shape 19 is positioned along the outer edges of the feet 14a and 13a and within an inwardly converging, inclined recess of ring member 16 to, at its upper end or face, support an angular stripper plate member 20, and to, at its edge or face, rest on the member 17. As shown particularly in FIG. 3, the stripper member 20 has a planar upper face portion that extends along the lower edge of the flask 10, and an inwardly sloped or declining upper face portion which rests against the lower edge of the refractory lining 11, against the lower end of the sand layer or thickness 12, and against an upper, outermost portion of the foot 13a of the inner sand thickness or layer 13. It will thus be noted that the metal components, parts or members do not directly contact the molten metal that is poured to form the ingot mold C; that is, the only contact is a minor one as provided by the innermost end of the stipper plate member 20.

One investigator in attempting to cast solid steel slabs and billets has shown the use of a throw-away, unfired, thin, ceramic lined enclosure within which molten metal is to be directly poured. A cooling water system is positioned about a relatively thin wall metal container to withdraw the intense heat that is generated. This approach has been found to be not only impractical but highly dangerous, since a liquid such as water must be avoided under the intense heat conditions which are encountered in a casting operation. In spite of the cooling action provided, the high heat which is imparted to the thin metal outer casing that supports the disposable ceramic mold within which the metal is directly poured will warp and thus cause damage to the casting being formed. Also, distinguished from this type of operation, the present casting method is designed to retain the casting heat and avoid rapidly dissipating it through the walls of the flask. This produces much better physicals in hollow castings being formed.

Although ordinary casting sand may be used, the quantity economy and the improved heat transfer control of my system makes fully practical the use of so-called no-bake, quick-set, resin containing sand. It facilitates the removal or stripping of the cast ingot mold, due to the tendency of the resin binders or quick-set sand to lose their strength after the completion of the operation; its lesser heat protecting ability is no longer an important factor in its usage. By way of example, using a system of the invention, the flask 10 may have a wall thickness of about 2 to 4 inches, the refractory walls 11 and 14 may each have a thickness of about 5 to 6 inches, and the thickness of the outer and inner sand layers 12 and 13 may be about 1 to 2 inches. The wall thicknesses of the refractory lining 11 and of the refractory coat 14 are, as an optimum, substantially the same, and should be at least twice the average wall thicknesses of the outer and inner said layers 12 and 13. Also, it is desirable to provide the lining 11 with a wall thickness that is at least equal to the thickness of the wall of the flask 10.

I claim:

1. An improved method of casting a hollow ingot which comprises, providing an outer hollow metal flask member with a refractory lining cemented in position about and along its inner surface, providing an innermost solid metal core bar with a refractory coat cemented in position about and along its outer surface, placing the core bar with its coat thereon in a spaced relation within and along the flask member with its lining thereon to form a casting assembly, introducing a body of casting sand into the spacing in direct facing contact with the refractory lining and coat, forming and setting the body of sand into a centrally disposed casting cavity having an upwardly open pour end portion therein, all in such a manner as to define inner and outer sand wall portions respectively along the refractory lining and coating of substantially lesser thickness than the lining and coating, pouring molten metal into the pour open end portion of and filling the casting sand cavity and forming an ingot shape therealong after the molten metal has cooled therein, and thereafter without disturbing the refractory lining and coat, removing the sand and the casting from an end of the spacing between the flask member and the core bar.

2. An improved method as defined in claim 1 wherein the casting sand is of a quick-set type, forming the casting cavity and setting the sand without baking it by a relatively short period of drying heat application thereto.

3. An improved method off casting metal ingot molds as defined in claim 1 wherein a stripper plate is positioned at a lower end of the flask member and its refractory lining and has a converging portion positioned to extend into the body of sand before the metal is poured, and the stripper plate is first removed from its defined position before removing the sand and the casting from one end of the spacing between the flask member and the core bar.

4. An improved assembly for casting a series of hollow metal ingots which comprises, an outer hollow metal flask, a centrally disposed solid metal core bar in a spaced relation along and within said flask, a refractory lining in a securely adhering relation along and about the inner wall of said flask, a refractory coat in a securely adhering relationship along and about the wall of said core bar and defining a restricted casting space with said refractory lining, a body of casting sand positioned in a covering relation along opposed faces of said refractory lining and coat and a casting cavity-defining relation with the casting space, removable means for closing-off a lower end of the casting cavity, and a refractory end portion resting on an inner surface of said closing-off means and defining a supporting lower end wall for said casting sand.

5. An improved casting assembly as defined in claim 4 wherein, the cross sectional thickness of said refractory lining is greater than the cross-sectional thickness of said casting sand between said lining and the casting cavity, and the cross-sectional thickness of the refractory coat is greater than the cross-sectional thickness of the casting sand between said coat and the casting cavity.

6. An improved assembly as defined in claim 5 wherein, individual wall thicknesses of said refractory lining and coat are at least twice the respective wall thicknesses of the casting sand between the casting cavity and said refractory lining and between the casting cavity and said refractory coat.

7. An improved assembly as defined in claim 5 wherein, said refractory lining and coat are respectively securely cemented in position on said flask and said core bar, whereby said lining and coat may be used without removal for a series of casting operations.

8. An improved assembly as defined in claim 5 wherein the upper end of the casting cavity is open for receiving molten metal therein.

9. An improved assembly as defined in claim 8 wherein said refractory end portion extends outwardly from said refractory coat into alignment with said refractory lining.

10. An improved assembly as defined in claim 5 wherein said closing-off means comprises, a pair of cooperating metal ring members and a metal stripper member supported by said ring members, and said stripper member has an inwardly declining portion on which a lower end of said refractory lining rests.

11. An improved assembly as defined in claim 5 wherein said closing-off means comprises, interfitting members having an annular metal stripper plate extending inwardly along a lower end of said refractory lining into an outer wall portion of said body of casting sand.

12. An improved assembly as defined in claim 5 wherein said refractory end portion constitutes an integral foot extending outwardly from the lower end of said refractory coat towards and into alignment with said refractory lining.

* * * * *